US006015085A

United States Patent [19]

Cannon et al.

[11] Patent Number: 6,015,085

[45] Date of Patent: Jan. 18, 2000

[54] COHESIVE PATTERN FOR A CONTINUOUS Z-FOLD MAILER WITH REPLY ENVELOPE

[75] Inventors: Terry K. Cannon, St. George, Utah; Tricia E. Sharp, Iowa City, Iowa

[73] Assignee: Moore U.S.A. Inc., Grand Island, N.Y.

[21] Appl. No.: 09/246,957

[22] Filed: Feb. 9, 1999

[51] Int. Cl.[7] ..... B65D 27/06

[52] U.S. Cl. ..... 229/305; 229/69

[58] Field of Search ..... 229/69, 92.1, 92.3, 229/304, 305

[56] References Cited

U.S. PATENT DOCUMENTS

| | | | |
|---|---|---|---|
| 3,482,780 | 12/1969 | Johnsen | 229/69 |
| 4,768,810 | 9/1988 | Mertens . | |
| 5,174,493 | 12/1992 | File . | |
| 5,289,972 | 3/1994 | Sauerwine et al. | 229/305 X |
| 5,360,159 | 11/1994 | Perriman | 229/92.3 |
| 5,372,302 | 12/1994 | Loch et al. . | |
| 5,376,048 | 12/1994 | Whiteside | 229/69 X |
| 5,402,934 | 4/1995 | Sauerwine . | |
| 5,409,752 | 4/1995 | Juteau . | |
| 5,513,795 | 5/1996 | Sauerwine | 229/305 |
| 5,553,774 | 9/1996 | Goodno . | |
| 5,829,670 | 11/1998 | Lombardo et al. | 229/69 X |

*Primary Examiner*—Jes F. Pascua
*Attorney, Agent, or Firm*—Nixon & Vanderhye P.C.

[57] ABSTRACT

A mailer type business form intermediate, and business form produced from the intermediate, are provided which provide a reply envelope as part of the mailer yet avoid blocking of pressure activated cohesive patterns associated with the mailer during fan-folding. The pressure activated cohesive patterns forming three side edges of the reply envelope are spaced and configured so that when intermediates are in fan-folded configuration the reply envelope pressure activated cohesive patterns are substantially non-overlapping so that blocking cannot occur. The pressure activated cohesive pattern forming one edge of the reply envelope can be provided by first and second series of pressure activated cohesive elements that are spaced from each other both in a direction parallel to, and perpendicular to, that side edge. A Z-fold mailer type business form is particularly advantageous.

20 Claims, 5 Drawing Sheets

COHESIVE PATTERN FOR A CONTINUOUS Z-FOLD MAILER WITH REPLY ENVELOPE

BACKGROUND AND SUMMARY OF THE INVENTION

Mailer type business forms which utilize pressure sensitive cohesive are becoming increasingly popular. Pressure sensitive cohesive in its commercial form typically is a styrene-natural rubber copolymer composition, such as shown in U.S. Pat. Nos. 4,918,128 and 5,427,851. Various other forms that the pressure sensitive cohesive may take, including commercial formulations thereof, are disclosed in U.S. Pat. No. 5,201,464 (the disclosure of which is hereby incorporated by reference herein). In the utilization of the mailer type business form intermediate which includes a pressure cohesive, cooperating patterns of cohesive are provided on cooperating faces of the intermediate which are folded into contact with each other. The mailer so formed is then run through conventional Moore SPEEDISEALER® pressure seal equipment (as generally illustrated in U.S. Pat. No. 5,397,427) so that a pressure of about 100–200 pounds per lineal inch is applied to the cohesive, to provide secure adhesion of the formed panels together. The pressure sensitive cohesive has numerous advantages over conventional heat seal adhesive and rewettable adhesive.

While mailer type business forms with pressure sensitive cohesive are extremely successful, there can be problems associated with blocking (that is where the cohesive patterns from one form engage cohesive patterns from another form when in a fan-folded, stacked, or roll configuration and cause some sticking), which can cause tearing or improper feeding of the forms. This is accounted for by providing particular configurations, and spacings, of the pressure sensitive cohesive patterns for a number of different types of forms such as shown in U.S. Pat. No. 5,829,670 and co-pending applications Ser. No. 08/935,770 filed Sep. 23, 1997, and Ser. No. 09/005,824 filed Jan. 12, 1998. While the disclosures in the last mentioned patent documents overcome the problem of blocking with respect to a variety of configurations of business form intermediates, those business forms do not have integrally formed reply envelopes associated therewith. When an integrally formed reply envelope is associated with the intermediate (such as in U.S. Pat. No. 5,553,774), special care needs to be taken.

According to the present invention a mailer type business form intermediate, and mailer type business forms made from the intermediate, are provided which essentially eliminate the problem of blocking when intermediates are fan-folded with respect to each other. This is accomplished by configuring, dimensioning, and positioning the cohesive patterns forming the reply envelope in a particular manner so that essentially they do not overlap (at least not to any significant extent) when the intermediates are in a fan-folded configuration. The preferred way that this can be accomplished is by spacing first and second lines of pressure sensitive cohesive elements forming one of the edges of the reply mailer so that they are spaced from each other both in a dimension parallel to the edge of the reply envelope that they form, and also perpendicular thereto. The invention is particularly useful in the construction of Z-fold mailer type business forms (both conventional Z-folded, and eccentric Z-folded), but also is applicable to simple V-fold constructions, or to C-fold constructions.

According to one aspect of the present invention a mailer type business form intermediate, including a reply envelope, is provided comprising the following elements: A substantially quadrate sheet of paper having first and second faces, top and bottom (end) edges substantially parallel to each other, and first and second side edges substantially perpendicular to the top and bottom edges and substantially parallel to each other. First and second lines of weakness formed in the sheet adjacent, but spaced from and substantially parallel to, the first and second side edges, respectively, to define first and second removable side margin portions. A first fold line formed in the sheet substantially parallel to the top and bottom edges, and defining the sheet into panels on opposite sides thereof. A pattern of pressure activated cohesive in each of the removable side margin portions on at least the second face, the first pattern on the first and second faces being configured and dimensioned to substantially prevent blocking when the intermediate is laid face-to-face with other intermediates in a fan-fold configuration. A second pattern of pressure activated cohesive formed in the panels on opposite sides of the first fold line for defining three edges of a reply envelope, the second pattern of pressure activated adhesive configured, dimensioned, and positioned so that blocking is substantially avoided when the intermediate is brought into face-to-face engagement with other intermediates in a fan-fold configuration. And, an activatable pattern of adhesive provided on one of the panels of the second face to seal a fourth edge of the reply envelope distinct from the first through third edges.

Preferably the mailer intermediate further comprises a third line of weakness substantially parallel to the first and second lines of weakness and extending through the panels, and defining with the second line of weakness removable stubs in both the panels, one of the removable stubs having the activatable adhesive thereon, and the third line of weakness defining the fourth edge of the reply envelope. The second pattern of pressure activated cohesive may comprise first and second longitudinal strips of cohesive provided on the second face in each of the panels and extending substantially parallel to the top and bottom edges and to each other, the first and second longitudinal strips in each of the panels spaced from the top and bottom edges and the first fold line so that when the sheet is folded about the first fold line to bring the second faces of the panels into contact with each other the first longitudinal strip of one panel is aligned with the first longitudinal strip of the other panel, and the second longitudinal strip of one panel is aligned with the second longitudinal strip of the other panel to define the first and third edges of the reply envelope.

The second pattern may further comprise a first series of spaced cohesive elements and a second series of spaced cohesive elements on panel second faces, the elements of each of the first and second series spaced from each other in a direction parallel to the side edges of the sheet, and the second series of elements also spaced from each other in a direction parallel to the sheet side edges; the first series spaced from the second series in a dimension parallel to the top and bottom edges, and the elements of the second series also spaced from the elements of the first series in a dimension parallel to the side edges of the sheet; and the first and second series of elements in one of the panels aligned respectively with the first and second series of elements in the other of the panels when the sheet is folded about the first fold line with the second faces of the panels brought into contact with each other. The first and second series of elements may comprise quadrate spots of pressure activated cohesive.

The intermediate may also comprise fourth and fifth lines of weakness parallel to the first fold line and straddling the first fold line, the first and second longitudinal strips of cohesive in both panels on the opposite side of the fourth and fifth lines of weaknesses from the first fold line, the fourth and fifth lines of weakness extending between the first and second lines of weakness. A second fold line may be formed in the sheet substantially parallel to the first fold line and defining the sheet into at least three panels, a first panel between the top edge and the first fold line, a second panel between the first fold line and the second fold line, and a third panel between the second fold line and the bottom edge, and the top and bottom edges spaced a first distance, and the side edges spaced a second distance, less than the first distance. The second fold line may be a line of weakness, and the first, second, and third panels may be of substantially the same size; and the intermediate may further comprise a third pattern of pressure sensitive adhesive provided on the first face in the second and third panels in the side margin portions sealing the first faces of the second and third panels together when the intermediate is Z-folded about the first and second fold lines.

Typically the activatable pattern of adhesive is provided on the second face of the stub of the second panel; and the intermediate further comprises outgoing address indicia imaged on the first face of the first panel and extending from one side of the third line of weakness to the other side of the third line of weakness and dimensioned so that when the stub of the first panel is removed and the stub of the second panel is folded over about the third line of weakness to bring the activatable pattern of adhesive into contact with the first face of the first panel, the stub of the second panel covers up any remaining outgoing address indicia on the first face of the first panel. Reply address indicia may be imaged on the first face of the second panel between the first and third lines of weakness. Address indicia corresponding to the outgoing address indicia may also be imaged on the first face of the second panel in a return address area of a reply envelope formed from the first and second panels, and confidentiality screening may be provided on the second face on each of the first through third panels.

The invention also relates to an intermediate as described above in combination with a plurality of other intermediates all connected along the top and bottom edges thereof, and in a fan-fold configuration so that the second faces of intermediates of a combination are in contact with second faces of other intermediates of a combination, and first faces of intermediates of a combination are in contact with the first faces of other intermediates of a combination, the intermediates being substantially devoid of cohesive blocking in the fan-folded configuration.

According to another aspect of the present invention a mailer type business form intermediate, including a reply envelope, is provided comprising the following elements: A substantially quadrate sheet of paper having first and second faces, top and bottom edges substantially parallel to each other, and first and second side edges substantially perpendicular to the top and bottom edges and substantially parallel to each other. First and second lines of weakness formed in the sheet adjacent, but spaced from and substantially parallel to, the first and second side edges, respectively, to define first and second removable side margin portions. A first fold line formed in the sheet substantially parallel to the top and bottom edges, and defining the sheet into panels on opposite sides thereof. A first pattern of pressure activated cohesive in each of the side margin portions on at least the second face. A second pattern of pressure activated cohesive provided on the second faces of two of the panels. An activatable pattern of adhesive provided on one of the panels of the second face to seal a fourth edge of the reply envelope distinct from the first through third edges. And, wherein the second pattern comprises a first series of spaced cohesive elements and a second series of spaced cohesive elements on the panel second faces, the elements of each of the first and second series spaced from each other in a direction parallel to the side edges of the sheet, and the second series of elements also spaced from each other in a direction parallel to the sheet side edges; the first series spaced from the second series in a dimension parallel to the top and bottom edges, and the elements of the second series also spaced from the elements of the first series in a dimension parallel to the side edges of the sheet; and the first and second series of elements in one of the panels aligned respectively with the first and second series of elements in the other of the panels when the sheet is folded about the first fold line with the second faces of the panels brought into contact with each other.

Preferably the mailer intermediate is constructed so that the second pattern of pressure activated cohesive also comprises first and second longitudinal strips of cohesive provided on the second faces in the panels and extending substantially parallel to the top and bottom edges and to each other, the first and second longitudinal strips in the panels spaced from the top and bottom edges and the first fold line so that when the sheet is folded about the first fold line to bring the second faces of the panels into contact with each other the first longitudinal strip of one panel is aligned with the first longitudinal strip of the other panel, and the second longitudinal strip of one panel is aligned with the second longitudinal strip of the other panel to define the first and third edges of the reply envelope. A third line of weakness may be provided substantially parallel to the first and second lines of weakness and extending through the panels, and defining with the second line of weakness removable stubs in both the panels, one of the removable stubs having the activatable adhesive thereon, and the third line of weakness defining the fourth edge of the reply envelope. The first and second series of elements may comprise quadrate spots of pressure activated cohesive.

A second fold line may be formed in the sheet substantially parallel to the first fold line and defining the sheet into at least three panels, a first panel between the top edge and the first fold line, a second panel between the first fold line and the second fold line, and a third panel between the second fold line and the bottom edge, and the top and bottom edges spaced a first distance, and the side edges spaced a second distance, less than the first distance.

The invention also relates to a business form formed by Z-folding any of the intermediates described above about the first and second fold lines thereof; or by V-folding a two-panel intermediate about the first fold line thereof so that the second faces of each panel are in contact with each other; or by C-folding an intermediate as described above about the first and second fold lines if the patterns of pressure activated cohesive and the outgoing address indicia, reply indicia, and the like, are properly configured and positioned.

It is the primary object of the present invention to provide a mailer type business form intermediate, and mailer formed therefrom, which includes a reply envelope, yet is substantially devoid of cohesive blocking when the intermediates are in a fan-folded configuration. This and other objects of the invention will become clear from an inspection of the detailed description of the invention and from the appended claims.

DETAILED DESCRIPTION OF THE DRAWINGS

Figure 1:
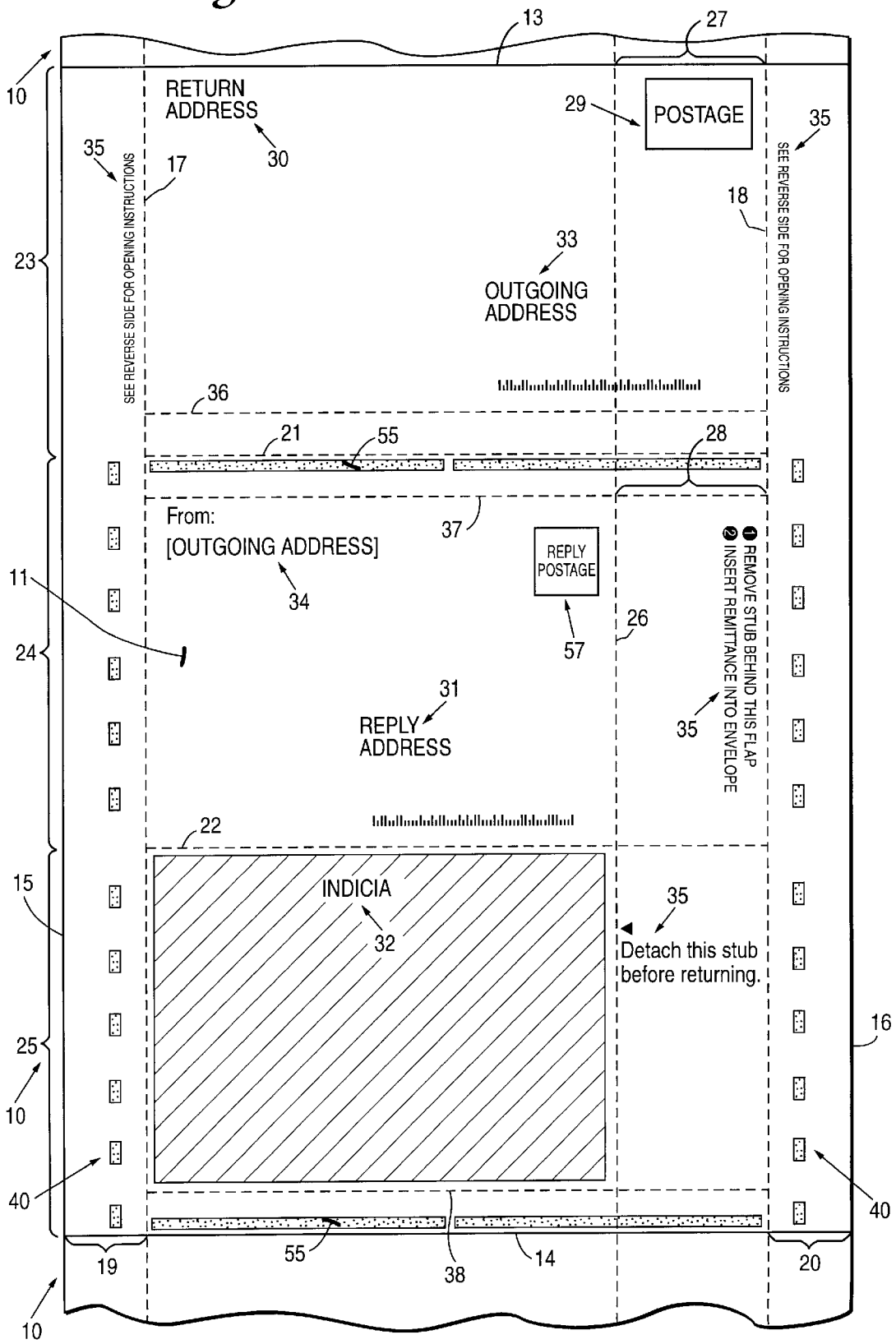
FIG. 1 is a top plan view of the first face of a business form intermediate according to the present invention, shown in continuous format with two like intermediates connected to the top and bottom edges thereof.
Figure 2:
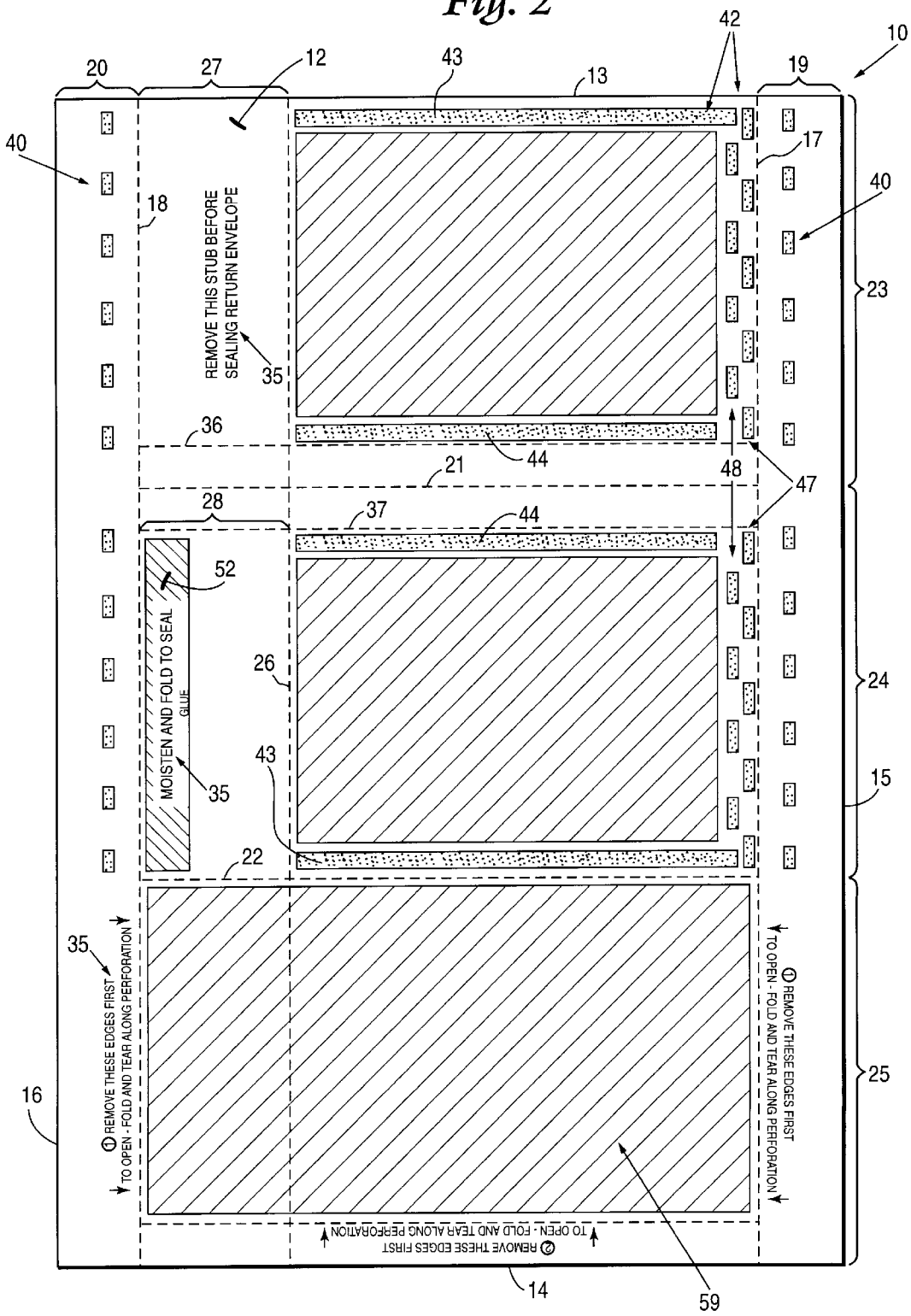
FIG. 2 is a top plan view of the second face of the business form intermediate of FIG. 1.
Figure 5:
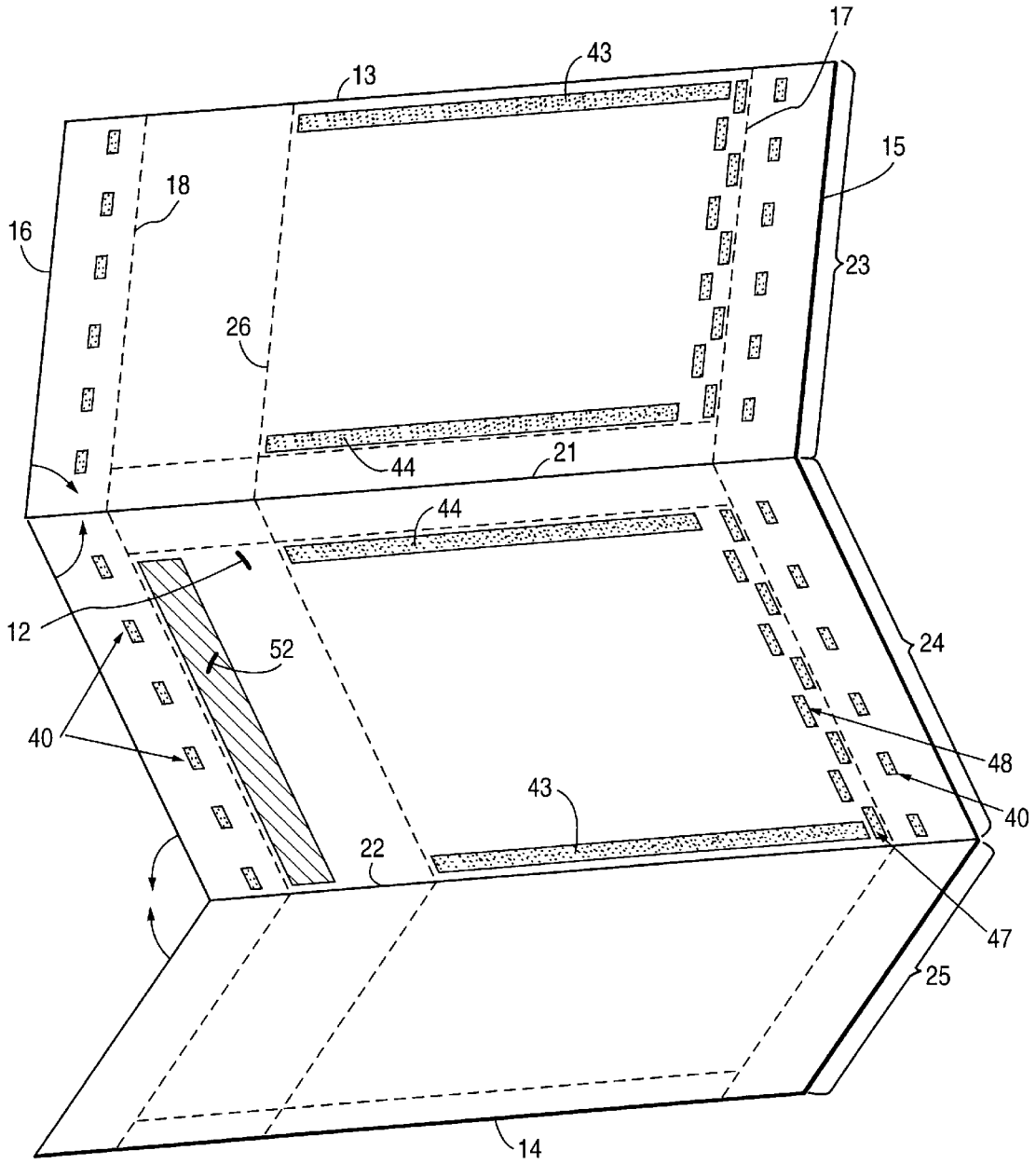
FIG. 5 is a perspective view of the intermediate of FIGS. 1 and 2 showing the second face thereof at the start of Z-folding thereof to form a mailer.

FIGS. 1, 2, and 5 in particular show an exemplary mailer type business form intermediate, including a reply envelope, according to the present invention, illustrated generally by reference numeral 10. That intermediate 10 comprises a substantially quadrate sheet of paper having a first face 11 (FIG. 1), a second face 12 (FIGS. 2 and 5), top and bottom edges 13, 14, respectively, substantially parallel to each other, and first and second side edges 15, 16 substantially parallel to each other and substantially transverse to the top and bottom edges 13, 14. Typically the top and bottom edges 13, 14 are spaced from each other a distance greater than the side edges 15, 16. As seen in FIG. 1, the top and bottom edges 13, 14 are typically at some stage during the formation of the intermediate 10 in continuous format with like intermediates 10, and also one or both of the side edges 15, 16 may also be in continuous format with like intermediates 10, and/or tractor drive strips may be provided at the side edges 15, 16.

The intermediate 10 also comprises first and second lines of weakness 17, 18, respectively, adjacent but spaced from and substantially parallel to the side edges 15, 16, respectively, to define first and second removable side edge portions 19, 20. The intermediate 10 also includes at least a first fold line 21 substantially parallel to the edges 13, 14, and in the preferred embodiment illustrated also includes a second fold line 22 parallel to the first line 21. The fold lines 21, 22, cooperating with the edges 13, 14, define the intermediate 10 into at least first and second panels 23, 24 and typically also at least a third panel 25, the first panel 23 between the edge 13 and first fold line 21, the second panel 24 between the fold lines 21, 22, the third panel 25 between the fold line 22 and bottom edge 14. Other panels may also be provided.

The intermediate 10 also preferably comprises a third line of weakness 26 parallel to the first and second lines 17, 18, and in the embodiment illustrated closer to the second line of weakness 18 than the first line 17. The third line of weakness 26 defines, with the second line of weakness 18, removable stubs including the stub 27 in the first panel 23 and the stub 28 in the second panel 24.

The intermediate 10 also includes non-variable indicia such as a postage designation 29, return address 30, reply address 31, and indicia 32, on the first face 11 of the intermediate 10, and also after variable printing has at least the outgoing address indicia 33 on the first face 11 of the first panel 23. Variable indicia may also be printed in the form of return address indicia 34 on the first face 11 of the second panel 24, and other variable indicia imbedded within or adjacent the indicia 32, or in the stubs 27, 28. The intermediate 10 also typically includes instructional indicia, telling the user how to use the mailer made from the intermediate 10, such instructional indicia being shown generally at 35 in FIGS. 1 and 2.

The outgoing address indicia 33, is illustrated in FIG. 1 and as known per se for intermediates and business forms with reply envelopes, preferably extends across the third line of weakness 26 from the main part of the first panel 23 into the removable stub 27. The part of the outgoing address indicia 33 that remains in the main panel 23 after the stub 27 has been removed is sufficient to be covered by the stub 28 when folded about the third line of weakness 26.

The intermediate 10, in the preferred embodiment illustrated, also preferably includes fourth and fifth lines of weakness 36, 37, respectively, which straddle and are substantially parallel to the first fold line 21, and may include a sixth line of weakness 38 parallel to the lines 36, 37 and adjacent the bottom edge 14.

The intermediate 10 also comprises a first pattern of pressure activated cohesive in each of said side margin portions 19, 20 on at least the second face 12 of the intermediate 10, these patterns being shown generally by reference numeral 40 in FIG. 2. For a V-fold mailer only the patterns in the panels 23, 24, on the second face 12 will be provided, whereas for a Z-fold mailer patterns 40 will also be provided in the second and third panels 24, 25 first face 11 as illustrated in FIG. 1, and for a C-fold mailer, will be provided on the second face of the third panel 25 and the first face 11 of the first panel 23. The pressure activated cohesive preferably is a styrene-natural rubber copolymer composition, various forms of which are disclosed in U.S. Pat. No. 5,201,464 which has been incorporated by reference herein, and typically which takes a pressure of about 100–200 pounds per lineal inch to seal, such as utilizing conventional Moore U.S.A., Inc. SPEEDISEALER® pressure seal equipment.

In the embodiments illustrated in FIGS. 1 and 2, the first pattern of pressure activated cohesive 40 is in the form of spaced rectangles, but other patterns could be provided including round dots, other polygonal shaped spots, or other configurations, as long as the elements 40 on one side of the fold line 21 come into contact with others on the opposite side of the fold line 21 when the faces 12 are brought into contact with each other, and the same thing for the elements 40 on opposite sides of the fold line 22 when the first faces 11 of panels 24, 25 are brought in contact with each other, when folding the intermediate 10 to produce a mailer.

Figure 3:
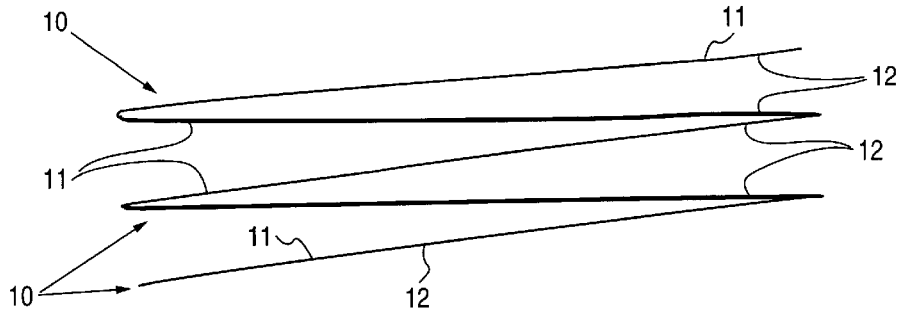
FIG. 3 is a side schematic view showing a plurality of the business form intermediates of FIGS. 1 and 2 in a fan-fold configuration.

The elements of the pattern 40 on both faces 11, 12 of the second panel 24, in the embodiment illustrated in the drawings, are spaced from each other in a dimension along the side edges 15, 16 so that when the faces of two intermediates 10 are in fan-folded configuration (as illustrated in FIG. 3) and in contact with each other there is no cohesive blocking. This is well known per se in conventional intermediates, such as shown in U.S. Pat. No. 5,829,670.

According to the present invention the intermediate 10 also includes a second pattern of pressure activated cohesive, shown only generally by reference numeral 42 in FIGS. 2 and 5, but by more specific reference numerals as described below. A second pattern of pressure sensitive cohesive 42 positioned, dimensioned, and configured—as illustrated in FIGS. 2 and 5—to cooperate with each other when the faces 12 of the panels 23, 24 are brought into contact with each other by folding about the first fold line 21. However it is important to position, configure, dimension the elements forming the pattern 42 so that there is no cohesive blocking when the intermediates 10 are in fan-fold configuration, such as illustrated in FIG. 3. This is accomplished, as most clearly illustrated in FIGS. 2, 4, and 5, by providing the individual elements forming the second pattern 42 so that they substantially do not overlap when the intermediate 10 is fan-folded with other intermediates.

Figure 7:
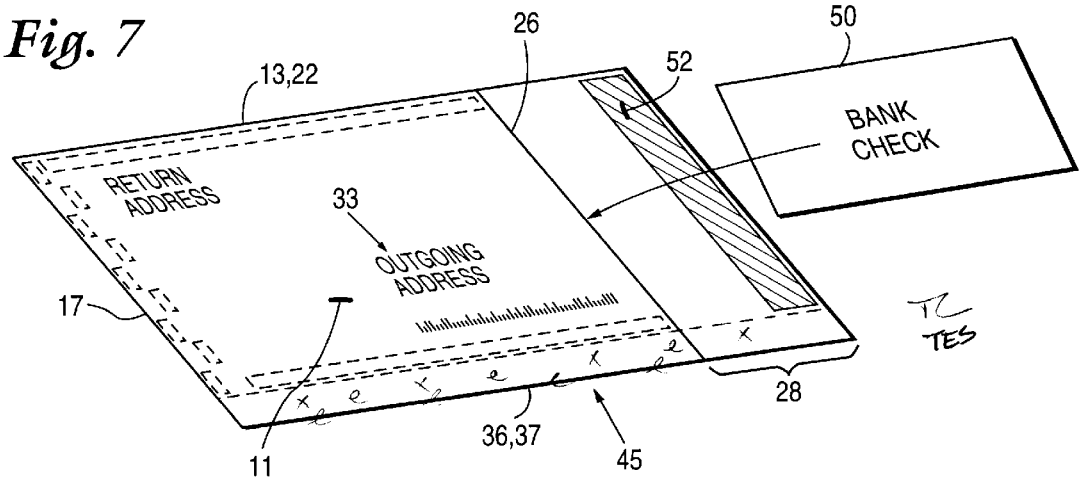
FIG. 7 is a rear perspective view of a reply envelope detached from the mailer of FIG. 6, and schematically illustrating the insertion of an insert therein.

In the preferred embodiment illustrated in the drawings, the second pattern 42 includes, on each of the panels 23, 24, first longitudinal and second longitudinal strips of cohesive 43, 44, respectively, extending substantially parallel to the top and bottom edges 13, 14. In the panel 23 the pattern 43 is adjacent the top edge 13 and the strip 44 adjacent the fourth line of weakness 36 and on the opposite side thereof from the first fold line 21. In the second panel 24 the strip 43 is adjacent the second fold line 22 (or bottom edge of a V-fold), and the strip 44 adjacent the fifth line of weakness 37, and on the opposite side thereof from the first fold line 21, as seen most clearly in FIG. 2. The pattern 42 closes off three sides of a reply envelope 45 (see FIGS. 7 and 8) constructed therefrom, the strips 43 closing off the first edge, and the strips 44 the third edge, and the series of elements 47, 48 closing off the second edge thereof. The fourth edge—adjacent the third line of weakness 26—is open to allow insertion of an insert (such as the insert 50 in FIG. 7) therein.

The first and second series of elements 47, 48 are, within each panel 23, 24, not only spaced from each other in a dimension parallel to the side edge 15, but also perpendicular thereto (that is in a dimension parallel to the top edge 13). The elements of the first series 47 within the first panel 23 align with the first series of elements 47 in the second panel 24 when the intermediate 10 is folded about the fold line 21 with the faces 12 of the panels 23, 24, into contact with each other, and similarly for the elements in the second series 48. In the embodiment illustrated in FIGS. 2, 4, and 5 the elements of the series 47, 48 are quadrate spots, but they can have a number of other configurations including round dots, spots of other polygon configurations, or the like. In the embodiment illustrated the series 47 comprises five individual elements and the series 48 four elements interspersed with the elements 47 along the dimension parallel to the edge 15; however any other number of elements that is operable may be provided.

Figure 4:
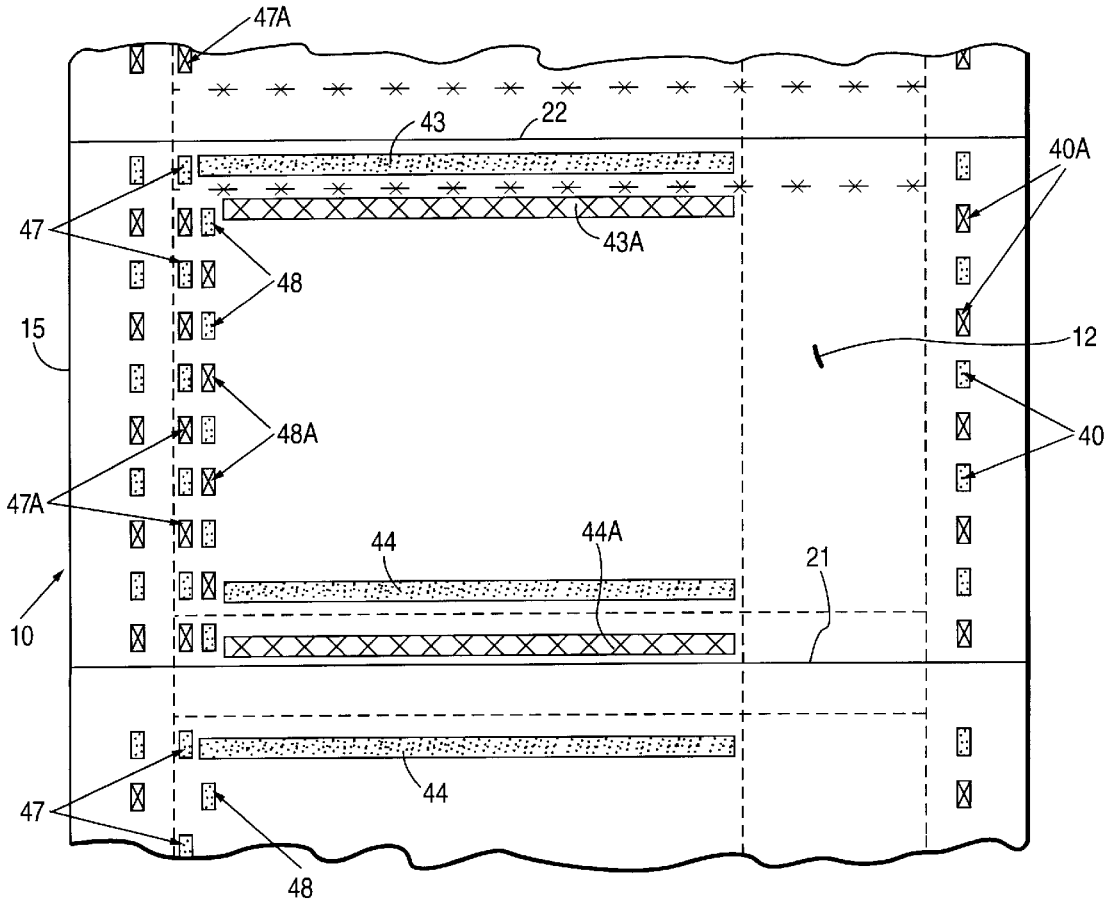
FIG. 4 is a plan view of the second face focused primarily on the center panel of one intermediate according to the invention and showing, with Xs associated therewith, the cohesive and line of weakness patterns of another intermediate in face-to-face contact.

FIG. 4 is a schematic representation which illustrates how the pressure activated cohesive elements of an intermediate 10 do not block (that is engage) those of another intermediate 10 when they are in the fan-folded configuration as illustrated in FIG. 3. This is illustrated in FIG. 4 by showing each of the pressure activated cohesive elements of the bottom intermediate 10 without anything within them, whereas the pressure activated cohesive elements of the overlying intermediate 10 when in the fan-folded configuration of FIG. 3 are shown with an "X" within them. The longitudinal strips 43, 44 are in the underlying intermediate 10 while the strips 43A, 44A are in the overlying fan-folded intermediate. The elements 40 are in the underlying intermediate 10 while the elements 40A are in the overlying fan-folded intermediate 10. The series of elements 47, 48 are in the underlying intermediate 10 while the series of elements 47A, 48A are in the fan-folded overlying intermediate 10. Thus FIG. 4 shows that there is no blocking when the intermediates are fan-folded (as in FIG. 3).

The reply envelope 45 also preferably comprises activatable adhesive that is disposed on the closing flap thereof for closing off the open (fourth) edge of the reply envelope 45. While the activatable adhesive may be provided on either of the stubs 27, 28, in the preferred embodiment the activatable adhesive—shown at 52 in FIGS. 2 and 5—is provided on the second face 12 of the stub 28. The activatable adhesive 52 may be rewettable adhesive, or it may be pressure sensitive adhesive covered by a release liner, or any other suitable conventional configuration.

In the Z-fold embodiment illustrated in the drawings, the panels 23, 24 are folded with respect to each (see FIG. 5) other about the first fold line 21 so that the faces 12 of the panels 23, 24 come in contact with each other and the cohesive elements 40, 43, 44, 47, and 48 engage each other, and the panel 25 is folded with respect to the panel 24 about the second fold line 22 so that the first faces 11 of the panels 24, 25 come in contact with each other. The second fold line 22 is preferably a line of weakness, such as a perforation line, and while the first fold line 21 may be too, it could also be a crease line or the like.

Figure 6:
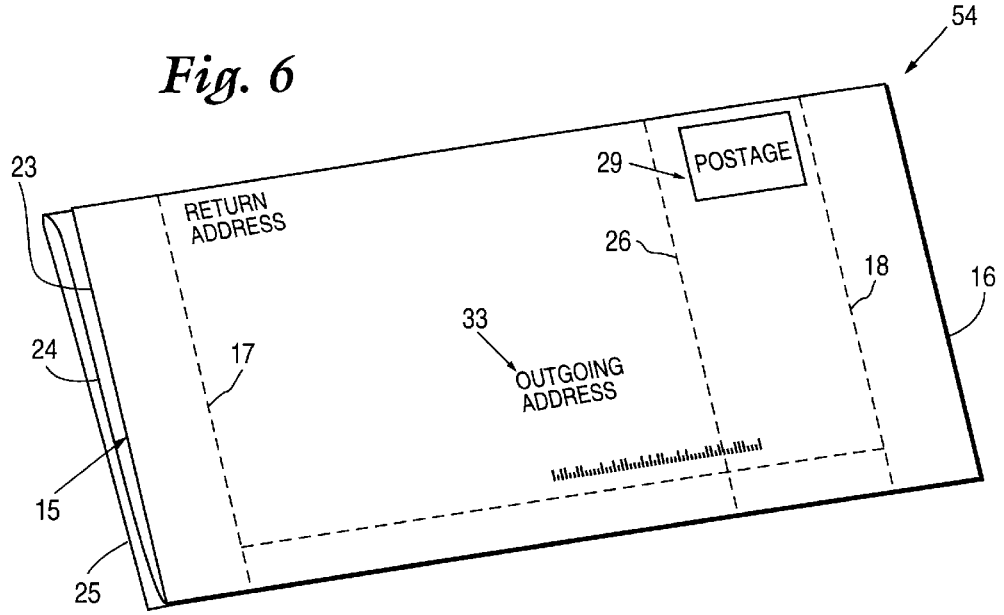
FIG. 6 is a top perspective view of a mailer type business form formed by Z-folding the intermediate of FIGS. 1, 2, and 5 about the first and second fold lines thereof.

When the panels 23–25 are Z-folded about the fold lines 21, 22 as schematically illustrated in FIG. 5 the mailer 54 of FIG. 6 is produced. The mailer is sealed by passing it through conventional pressure seal equipment, such as Moore SPEEDISEALER® equipment, which applies a force of about 100–200 pounds per lineal inch to all of the cohesive patterns so that all of the cooperating elements 40, 43, 44, 47, and 48 are sealed with respect to each other, as well as the optional pressure activated cohesive strips 55 illustrated in FIG. 1.

Figure 8:
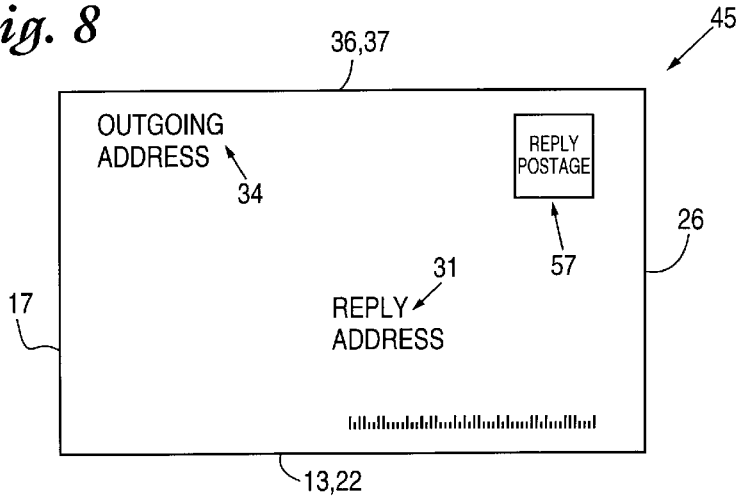
FIG. 8 is a front view of the reply envelope of FIG. 7 when sealed and ready to be sent to the reply address thereon.

When the mailer 54 is received by the outgoing addressee (33) the addressee tears along the lines of weakness 17, 18 to open up the mailer 54, which then comprises the reply envelope 45 with stubs 27, 28 attached, as well as the portion of the panel 25 between the lines of weakness 17, 18 still connected along the second fold line 22. Then the panel 25 is removed along the fold line (e.g. line of perforation) 22, and the stub 27 is removed by tearing along the third fold line 26. The first edge of the reply envelope 45 is formed by the top edge 13 and second fold line 22 of the intermediate 10, while the second edge is formed by tearing along the fourth and fifth lines of weakness 36, 37, resulting in the reply envelope 45 illustrated in FIG. 7. Then part or all of the panel 25 that has been removed—if it has appropriate indicia 32—may be inserted into the open fourth edge of the reply envelope 45, along with a bank check 50, or other inserts, and the stub/flap 28 folded about the third line of weakness 26, the activatable adhesive 52 activated, and the adhesive 52 then in sealed relationship with the first face 11 of the first panel 23. The stub/flap 28 covers up any remaining portion of the outgoing address 33 that was not already removed by removal of the stub 27. Typically the return address 30 and the reply address 31 on the front face of the reply envelope 45 (see FIG. 8) are the same so that post office personnel will not be confused. However if the return address 30 is different it may be covered up with a label (provided as part of the mailer of FIG. 6) or otherwise handled in a conventional manner. However since only the reply postage indicia area 57 is on the front face of the reply envelope 45 (as seen in FIG. 8) there should be no confusion by post office personnel.

Typically when the intermediates 10 are in the fan-folded configuration illustrated in FIG. 3 they are fed to a printer, which may be a simplex printer, which prints any variable information, such as the outgoing address 33 (and perhaps the address 34), as well as any variable portion of the indicia 32, on the first face 11 of the intermediate 10.

The intermediate 10 also may have conventional confidential screening, shown schematically by the diagonal lines 59 in FIG. 2, on the second face 12 of each of the panels 23–25 to maintain the contents of the mailer 54 and reply envelope 45 confidential.

If a V-fold mailer is made from the intermediate 10 (that is the panel 25 is not provided), then the reply address 31 on the outgoing mailer 54 is preferably covered with a label (which has indicia on it indicating it should be removed when received by the recipient so that there will be no confusion about whom the mailer 54 is addressed to).

It will thus be seen that according to the present invention a mailer type business form intermediate, with included reply envelope, as well as a mailer made therefrom, are provided which have a simple yet effective construction, and which preclude cohesive blocking when the intermediates 10 are in a fan-folded configuration as illustrated in FIG. 3. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent intermediates and mailers.

What is claimed is:

1. A mailer type business form intermediate, including a reply envelope, comprising:

a substantially quadrate sheet of paper having first and second faces, top and bottom edges substantially parallel to each other, and first and second side edges substantially perpendicular to said top and bottom edges and substantially parallel to each other;

first and second lines of weakness formed in said sheet adjacent, but spaced from and substantially parallel to, said first and second side edges, respectively, to define first and second removable side margin portions;

a first fold line formed in said sheet substantially parallel to said top and bottom edges, and defining said sheet into panels on opposite sides thereof;

a first pattern of pressure activated cohesive in each of said removable side margin portions on at least said second face, said first pattern on said first and second faces being configured and dimensioned to substantially prevent blocking when said intermediate is laid face-to-face with other intermediates in a fan-fold configuration;

a second pattern of pressure activated cohesive formed in said panels on opposite sides of said first fold line for defining three edges of a reply envelope, said second pattern of pressure activated adhesive configured, dimensioned, and positioned so that blocking is substantially avoided when said intermediate is brought into face-to-face engagement with other intermediates in a fan-fold configuration; and an activatable pattern of adhesive provided on one of said panels of said second face to seal a fourth edge of said reply envelope distinct from said first through third edges.

2. A mailer intermediate as recited in claim 1 further comprising a third line of weakness substantially parallel to said first and second lines of weakness and extending through said panels, and defining with said second line of weakness removable stubs in both said panels, one of said removable stubs having said activatable adhesive thereon, and said third line of weakness defining said fourth edge of said reply envelope.

3. A mailer intermediate as recited in claim 2 wherein said second pattern of pressure activated cohesive comprises first and second longitudinal strips of cohesive provided on said second face in each of said panels and extending substantially parallel to said top and bottom edges and to each other, said first and second longitudinal strips in each of said panels spaced from said top and bottom edges and said first fold line so that when said sheet is folded about said first fold line to bring said second faces of said panels into contact with each other said first longitudinal strip of one panel is aligned with said first longitudinal strip of said other panel, and said second longitudinal strip of one panel is aligned with said second longitudinal strip of the other panel to define said first and third edges of said reply envelope.

4. A mailer intermediate as recited in claim 3 wherein said second pattern further comprises a first series of spaced cohesive elements and a second series of spaced cohesive elements on said panel second faces, said elements of each of said first and second series spaced from each other in a direction parallel to said side edges of said sheet, and said second series of elements also spaced from each other in a direction parallel to said sheet side edges; said first series spaced from said second series in a dimension parallel to said top and bottom edges, and said elements of said second series also spaced from said elements of said first series in a dimension parallel to said side edges of said sheet; and said first and second series of elements in one of said panels aligned respectively with said first and second series of elements in the other of said panels when said sheet is folded about said first fold line with said second faces of said panels brought into contact with each other.

5. A mailer intermediate as recited in claim 4 wherein said first and second series of elements comprise quadrate spots of pressure activated cohesive.

6. A mailer intermediate as recited in claim 4 further comprising fourth and fifth lines of weakness parallel to said first fold line and straddling said first fold line, said first and second longitudinal strips of cohesive in both panels on the opposite side of said fourth and fifth lines of weaknesses from said first fold line, said fourth and fifth lines of weakness extending between said first and second lines of weakness.

7. A mailer intermediate as recited in claim 6 further comprising a second fold line formed in said sheet substantially parallel to said first fold line and defining said sheet into at least three panels, a first panel between said top edge and said first fold line, a second panel between said first fold line and said second fold line, a third panel between said second fold line and said bottom edge, and said top and bottom edges spaced a first distance, and said side edges spaced a second distance, less than said first distance.

8. A mailer intermediate as recited in claim 7 wherein said second fold line is a line of weakness, and wherein said first, second, and third panels are of substantially the same size; and further comprising a third pattern of pressure sensitive adhesive provided on said first face in said second and third panels in said side margin portions sealing said first faces of said second and third panels together when said intermediate is Z-folded about said first and second fold lines.

9. A mailer intermediate as recited in claim 8 wherein said activatable pattern of adhesive is provided on said second face of said stub of said second panel; and further comprising outgoing address indicia imaged on said first face of said first panel and extending from one side of said third line of weakness to the other side of the third line of weakness and dimensioned so that when said stub of said first panel is removed and said stub of said second panel is folded over about said third line of weakness to bring said activatable pattern of adhesive into contact with said first face of said first panel, said stub of said second panel covers up any remaining outgoing address indicia on said first face of said first panel.

10. A mailer intermediate as recited in claim 9 further comprising reply address indicia imaged on said first face of said second panel between said first and third lines of weakness.

11. A mailer intermediate as recited in claim 10 further comprising address indicia corresponding to said outgoing address indicia variably imaged on said first face of said second panel in a return address area of a reply envelope formed from said first and second panels.

12. A mailer intermediate as recited in claim 10 further comprising confidentiality screening provided on said second face on each of said first through third panels.

13. A mailer intermediate as recited in claim 1 in combination with a plurality of other intermediates all connected along the top and bottom edges thereof, and in a fan-fold configuration so that said second faces of intermediates of a combination are in contact with second faces of other intermediates of a combination, and first faces of intermediates of a combination are in contact with the first faces of other intermediates of a combination, said intermediates being substantially devoid of cohesive blocking in said fan-folded configuration.

14. A mailer type business form intermediate, including a reply envelope, comprising:

a substantially quadrate sheet of paper having first and second faces, top and bottom edges substantially parallel to each other, and first and second side edges substantially perpendicular to said top and bottom edges and substantially parallel to each other;

first and second lines of weakness formed in said sheet adjacent, but spaced from and substantially parallel to, said first and second side edges, respectively, to define first and second removable side margin portions;

a first fold line formed in said sheet substantially parallel to said top and bottom edges, and defining said sheet into panels on opposite sides thereof;

a first pattern of pressure activated cohesive in each of said side margin portions on at least said second face;

a second pattern of pressure activated cohesive provided on said second faces of two of said panels;

an activatable pattern of adhesive provided on said second face of one of said panels to seal a fourth edge of said reply envelope distinct from said first through third edges; and wherein said second pattern comprises a first series of spaced cohesive elements and a second series of spaced cohesive elements on said panel second faces, said elements of each of said first and second series spaced from each other in a direction parallel to said side edges of said sheet, and said second series of elements also spaced from each other in a direction parallel to said sheet side edges; said first series spaced from said second series in a dimension parallel to said top and bottom edges, and said elements of said second series also spaced from said elements of said first series in a dimension parallel to said side edges of said sheet; and said first and second series of elements in one of said panels aligned respectively with said first and second series of elements in the other of said panels when said sheet is folded about said first fold line with said second faces of said panels brought into contact with each other.

15. A mailer intermediate as recited in claim 14 wherein said second pattern of pressure activated cohesive also comprises first and second longitudinal strips of cohesive provided on said second faces in said panels and extending substantially parallel to said top and bottom edges and to each other, said first and second longitudinal strips in said panels spaced from said top and bottom edges and said first fold line so that when said sheet is folded about said first fold line to bring said second faces of said panels into contact with each other said first longitudinal strip of one panel is aligned with said first longitudinal strip of said other panel, and said second longitudinal strip of one panel is aligned with said second longitudinal strip of the other panel to define said first and third edges of said reply envelope.

16. A mailer intermediate as recited in claim 15 further comprising a third line of weakness substantially parallel to said first and second lines of weakness and extending through said panels, and defining with said second line of weakness removable stubs in both said panels, one of said removable stubs having said activatable adhesive thereon, and said third line of weakness defining said fourth edge of said reply envelope.

17. A mailer intermediate as recited in claim 14 wherein said first and second series of elements comprise quadrate spots of pressure activated cohesive.

18. A mailer intermediate as recited in claim 14 further comprising a second fold line formed in said sheet substantially parallel to said first fold line and defining said sheet into at least three panels, a first panel between said top edge and said first fold line, a second panel between said first fold line and said second fold line, a third panel between said second fold line and said bottom edge, and said top and bottom edges spaced a first distance, and said side edges spaced a second distance, less than said first distance.

19. A mailer type business form made by Z-folding the intermediate of claim 8 about said first and second fold lines.

20. A mailer type business form made by Z-folding the intermediate of claim 18 about said first and second fold lines.

* * * * *